US006744302B2

(12) United States Patent
Oikawa et al.

(10) Patent No.: US 6,744,302 B2
(45) Date of Patent: Jun. 1, 2004

(54) VOLTAGE GENERATOR CIRCUIT FOR USE IN A SEMICONDUCTOR DEVICE

(75) Inventors: Kohei Oikawa, Kamakura (JP); Shinichiro Shiratake, Yokohama (JP); Daisaburo Takashima, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/310,053

(22) Filed: Dec. 5, 2002

(65) Prior Publication Data

US 2003/0107362 A1 Jun. 12, 2003

(30) Foreign Application Priority Data

Dec. 7, 2001 (JP) ..... 2001-374734

(51) Int. Cl.[7] ..... G05F 1/10
(52) U.S. Cl. ..... 327/538; 327/542; 327/404
(58) Field of Search ..... 327/538, 542, 327/543, 540, 403, 404; 323/315

(56) References Cited

U.S. PATENT DOCUMENTS 4,734,751 A * 3/1988 Hwang et al. ..... 257/259
4,901,032 A * 2/1990 Komiak ..... 330/277
6,333,668 B1 12/2001 Takashima

FOREIGN PATENT DOCUMENTS

JP 2002-329791 11/2002

OTHER PUBLICATIONS

Daeje Chin, et al. "An Experimental 16–MBIT DRAM with Reduced Peak–Current Noise" IEEE Journal of Solid–State Circuits, vol. 24, No. 5, Oct. 1989, pp. 1191–1197.

* cited by examiner

*Primary Examiner*—Shawn Riley
(74) *Attorney, Agent, or Firm*—Oblon, Spivak, McClelland, Maier & Neustadt, P.C.

(57) ABSTRACT

A voltage generator circuit generates a voltage supplied to an internal circuit. The voltage generator circuit includes first, second, and third switching elements each having first and second terminals. The first terminal of each of the switching elements is connected to the power source terminal supplied with a power source voltage. First, second, and third transistors each have a current path which has first and second ends. The first ends of the first, second, and third transistors are respectively connected to the second terminals of the first, second, and third switching elements. The first, second, and third transistors have respectively first, second, and third driving capabilities. The first, second, and third driving capabilities are different from each other. The second ends of the current paths of the first, second, and third transistors are connected to an output terminal which outputs the voltage supplied to the internal circuit.

21 Claims, 7 Drawing Sheets

VOLTAGE GENERATOR CIRCUIT FOR USE IN A SEMICONDUCTOR DEVICE

CROSS-REFERENCE TO RELATED APPLICATIONS

This application is based upon and claims the benefit of priority from the prior Japanese Patent Application No. 2001-374734, filed Dec. 7, 2001, the entire contents of which are incorporated herein by reference.

BACKGROUND OF THE INVENTION

1. Field of the Invention

The present invention relates to, for example, a voltage generator circuit. More specifically, the present invention relates to a voltage generator circuit for use in a semiconductor device such as a semiconductor memory or the like.

2. Description of the Related Art

A semiconductor device such as a semiconductor memory device or the like has a voltage generator circuit which supplies a predetermined potential to generate a bias and the like necessary for its operations. The voltage generator circuit is constructed, for example, by using transistors, resistor elements, and the like. A constant potential should desirably be supplied, independently from changes in load currents.

FIG. 10 shows an example of a conventional voltage generator circuit 22 used in a semiconductor device. This kind of voltage generator circuit is described in Japanese Patent Application No. 2001-133460. As shown in FIG. 10, a P-type MOS (Metal Oxide Semiconductor) TP21 and an N-type MOS transistor TN21 connected in series are provided between a feed end of a power-source voltage and an output end of a voltage. Similarly, MOS transistors TP22 and TN22 connected in series are provided between the supplying end of a power-source potential and the output end of a voltage. The gate of the MOS transistor TP21 is supplied with a NOT (or inverted) logic signal (hereinafter the "NOT logic" will be referred to merely by "/") of a signal "standby" which corresponds to a standby period of a semiconductor memory, from a control circuit not shown. The gate of the MOS transistor TP22 is supplied with a signal "/active" which corresponds to an active period of a semiconductor memory. Reference symbol I21 denotes a load current.

The MOS transistors TN21 and TN22 have gate widths different from each other. As shown in FIG. 11, the gate widths are designed such that the voltage generator circuit 22 outputs a voltage of about 2.5 V, using the MOS transistor TN 21 when the lord current I21 is 100 nA, and using the MOS transistor TN 22 when the lord current I21 is 1 mA.

The operation of the voltage generator circuit 22 thus constructed will now be explained schematically. As shown in FIG. 12, while the semiconductor memory is in a standby state, the MOS transistor TN21 shown in FIG. 10 turns on. At this time, the load current 121 is about 0.1 $\mu$A. While the semiconductor memory performs a sensing operation, the MOS transistor TN22 shown in FIG. 10 turns on. The sensing period is given to read, by means of a sense amplifier, the electric charge which has moved from a memory cell to a bit line. A greater current is therefore consumed to drive the sense amplifier. During the sensing period, the load current I21 is, for example, 1 mA.

During a restoring period, the semiconductor memory writes back data retained by the sense amplifier into a memory cell. The load current is about 0.1 to 10 $\mu$A in the restoring period. Then, the semiconductor memory shifts to a standby state, and the MOS transistor TN21 turns on again. In series of the mentioned operations, the output voltage of the voltage generator circuit is maintained substantially at 2.5 V, as shown in FIG. 11.

As described above, the output voltage is kept constant by controlling the MOS transistors TN21 and TN22 in accordance with the state of the semiconductor memory.

Meanwhile, several semiconductor memories further cover a holding operation in addition to the sensing and restoring operations, during the active period. During the holding period, the sense amplifier does not write back but holds the read data. The holding period is very short in normal accessing methods. In several accessing methods, however, the holding period is long. An example of such a long holding period will be a case that a long time is required until a writing operation starts after the operation of the sense amplifier because the memory device is operated at a cycle time slower than a fastest cycle time. In addition, the holding period is long if the memory device is operated in a page mode.

FIG. 13 shows a load current and an output voltage when a conventional voltage generator circuit is used in a semiconductor memory having a long holding period. As shown in FIG. 13, the voltage generator circuit drives the MOS transistor TN22 through sensing, holding, and restoring periods. The output voltage, however, increases because the load current I21 is as low as about 10 $\mu$A during the holding period. If the restoring period is started in a state that the output voltage is high, the voltage applied to the memory cell increases. The reliability of the memory cell therefore deteriorates, e.g., capacitors of memory cells are degraded.

BRIEF SUMMARY OF THE INVENTION

According to a first aspect of the present invention, there is provided a voltage generator circuit which generates a voltage supplied to an internal circuit, and comprises: a power source terminal supplied with a power source voltage; first, second, and third switching elements each having first and second terminals, the first terminal of each of the switching elements being connected to the power source terminal; a first transistor having a first driving capability and a current path which has first and second ends, the first end being connected to the second terminal of the first switching element; a second transistor having a second driving capability, which is different from the first driving capability, and a current path which has first and second ends, the first end being connected to the second terminal of the second switching element; a third transistor having a third driving capability, which is different from the first and second driving capabilities, and a current path having first and second ends, the first end being connected to the second terminal of the third switching element; and an output terminal which outputs the voltage supplied to the internal circuit and is connected to the second end of each of the current paths of the first, second, and third transistors.

DETAILED DESCRIPTION OF THE INVENTION

Embodiments of the present invention will now be described with reference to the drawings. In the following description, those components that have substantially identical functions and structures are denoted at identical reference symbols. Reiterative explanation to those components will be made only when necessary.

(First Embodiment)

Figure 1:
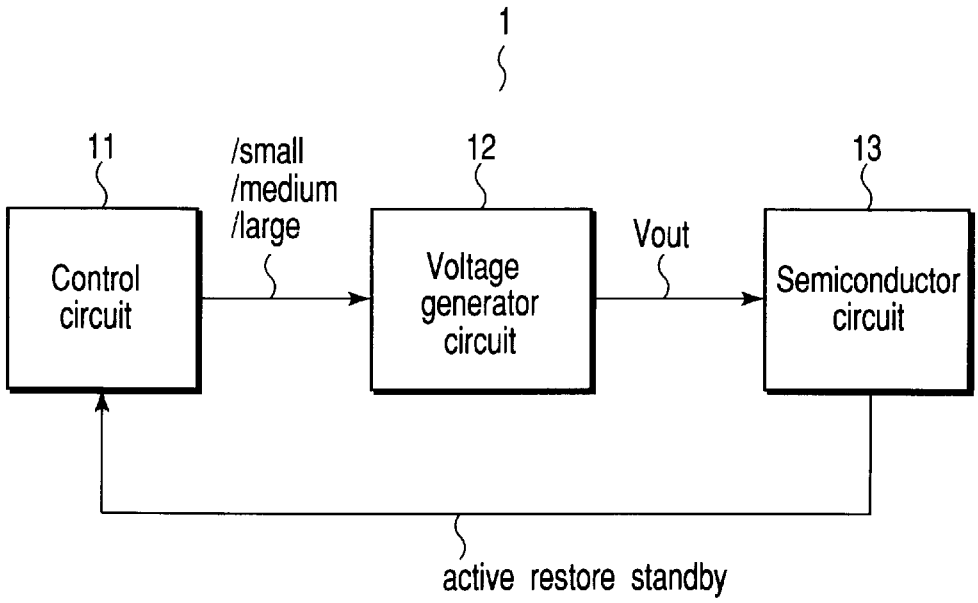
FIG. 1 is a diagram schematically showing the configuration of a semiconductor device which uses the voltage generator circuit according to embodiments of the present invention.

FIG. 1 schematically shows the structure of a semiconductor device which uses a voltage generator circuit according to embodiments of the present invention. As shown in FIG. 1, a semiconductor device 1 includes a control circuit 11 for a semiconductor memory device and the like, a voltage generator circuit 12, and a semiconductor circuit (internal circuit) 13. The control circuit 11 is connected to the voltage generator circuit 12 and the semiconductor circuit 13. The voltage generator circuit 12 is connected to the semiconductor circuit 13. Used as the semiconductor circuit 13 is a semiconductor memory device such as a DRAM (Dynamic Random Access Memory), FeRAM, (Ferroelectric RAM), or the like, for example.

The control circuit 11 generates control signals "/small", "/medium", and "/large" in correspondence with signals "active", "restore", and "standby" which are generated by a control circuit (not shown) in the semiconductor circuit 13. For example, the control signals "/small", "/medium", and "/large" are generated in accordance with operation modes of the semiconductor circuit 13, and then supplied to the voltage generator circuit 12. Details of the control signals will be described later. The voltage generator circuit 12 is controlled by the control signals generated from the control circuit 11. The semiconductor circuit 13 is supplied with a voltage Vout from the voltage generator circuit 12.

Figure 2:
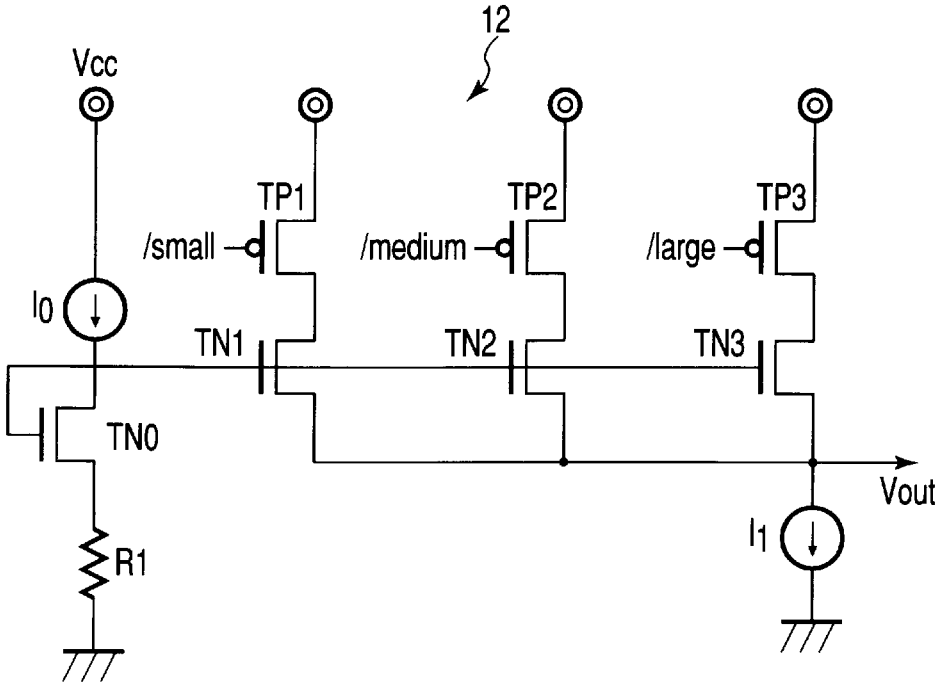
FIG. 2 is a diagram schematically showing the voltage generator circuit according to the embodiment of the present invention.

FIG. 2 schematically shows a voltage generator circuit 12 according to an embodiment of the present invention. As shown in FIG. 2, a predetermined current I0 is supplied to an end of a resistor R1 through an N-type MOS transistor TN0. The other end of the resistor R1 is grounded.

A power-source terminal which supplies a power-source potential, for example, VCC is connected to an end of a channel of an N-type MOS transistor TN1 through a P-type MOS transistor TP1. The MOS transistor TP1 functions as a switching element. An output voltage Vout is extracted from another end of the channel of the MOS transistor TN1. The gate of the MOS transistor TP1 is supplied with the signal "/small". The gate of the MOS transistor TN1 is connected to the gate of the MOS transistor TN0. Note that a constant current source section I1 in FIG. 2 indicates a load current which flows through the circuit (e.g., the semiconductor circuit 11 in FIG. 1) supplied with the output voltage Vout.

Similarly, the potential VCC is changed into an output voltage Vout through a P-type MOS transistor TP2 and N-type MOS transistor TN2 connected in series and through a P-type MOS transistor TP3 and an N-type MOS transistor TN3 also connected in series. The MOS transistors TP2 and TP3 each functions as a switching element. The gate of the MOS transistor TP2 is supplied with the signal "/medium", as well as the gate of the MOS transistor TP3 with the signal "/large" (which will be described later). In addition, the gates of the MOS transistors TN2 and TN3 are connected to the gate of the transistor TN1.

Driving capabilities of the MOS transistors TN1 to TN3 differ from each other. The differences can be attained, for example, by varying the gate widths of the MOS transistors TN1 to TN3. In the present embodiment, the driving capabilities are arranged in the ascending order from TN1 to TN3. In other words, the gate width increases in the order from TN1 to TN3, for example. The channel width and channel length of each of the MOS transistors TN1 to TN3 are designed to perform a desired operation which will be described later.

Explained next will be concrete examples of the channel widths and channel lengths of the MOS transistors TN1 to TN3. The MOS transistor TN1 is designed such that the load current at the time of standby can be maintained. The present embodiment is designed such that the output voltage is 2.5 V when the load current I1 is, for example, 100 nA. The ratio of the gate width W/gate length L (hereinafter referred to only by "W/L") is 5 $\mu$m/0.5 $\mu$m.

Similarly, the MOS transistor TN2 is designed such that the load current can be maintained during the holding period. The present embodiment is arranged such that the output voltage is 2.5 V when the load current I1 is, for example, 10 $\mu$A. E.g., W/L of the gate is 500 $\mu$m/0.5 $\mu$m.

The MOS transistor TN3 is designed such that the active current and the maximum load current can be maintained. The present embodiment is arranged such that the output voltage is 2.5 V when the load current I1 is, for example, 1 mA. E.g., W/L is 50 mm/0.5 $\mu$m.

Figure 3:
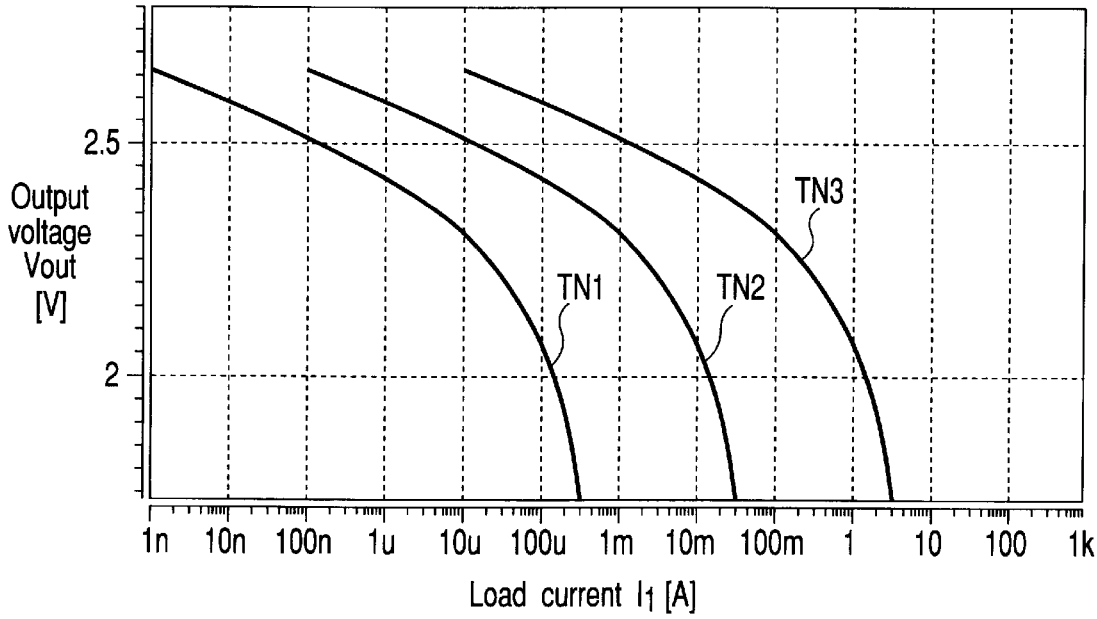
FIG. 3 is a graph showing load characteristics of respective MOS transistors.

FIG. 3 is a graph showing the load characteristics of the MOS transistors TN1 to TN3. As shown in FIG. 3, the MOS transistors TN1 to TN3 are designed such that the output voltage is 2.5 V when the load currents is 100 nA, 10 $\mu$A, and 1 mA, respectively.

Figure 4:
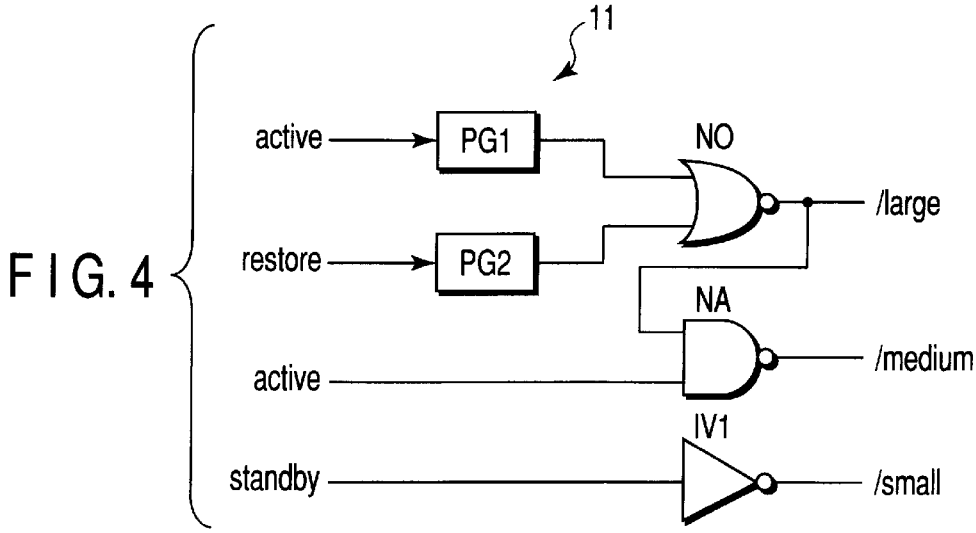
FIG. 4 is a diagram schematically showing a control circuit.

FIG. 4 schematically shows the control circuit 11. The control circuit 11 generates the signals "/small", "/medium", and "/large" described previously. As shown in FIG. 4, a signal "active" is supplied to a pulse generator PG1 from a control circuit and the like (not shown) in the semiconductor circuit 11 shown in FIG. 1. The signal "active" is supplied while the semiconductor memory is active. The pulse generator PG1 detects an input signal and generates a pulse signal for a predetermined time period. The structure of the pulse generator PG1 will be described later. The output of the pulse generator PG1 is supplied to an input end of a NOR circuit NO.

The signal "restore" is supplied to another pulse generator PG2. The signal "restore" is supplied while the semiconductor memory is executing the restoring operation. The output of the pulse generator PG2 is supplied to the other input end of the NOR circuit NO. The pulse generator PG2 functions in the same way as the pulse generator PG1 except that it is different from the pulse generator PG1 in the length of the pulse to be generated. The output of the NOR circuit NO is taken as the signal "/large" and also supplied to an input end of a NAND circuit NA.

The signal active is also supplied to the other input end of the NAND circuit NA. The output of the NAND circuit NA is taken as the signal "/medium". The standby signal "standby", which is supplied during the standby period of the semiconductor memory, is taken as the signal "/small"through an inverter IV1.

Figure 5:
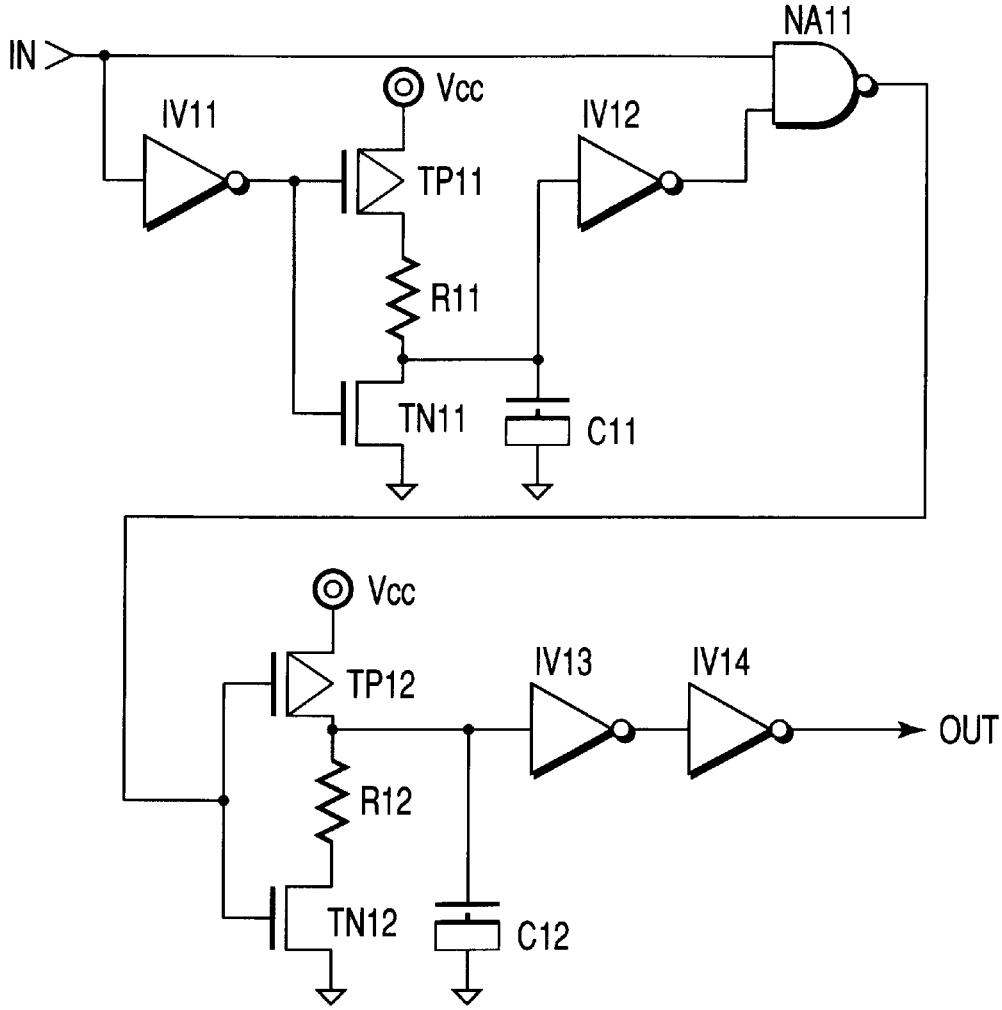
FIG. 5 is a diagram schematically showing pulse generators.

FIG. 5 is a circuit diagram schematically showing the pulse generators PG1 and PG2. As shown in FIG. 5, the input signal is supplied to an input end of a NAND element NA11 and also to an inverter circuit IV11. The output of the inverter circuit TV11 is supplied to the gate of a P-type MOS transistor TP11 and also to the gate of an N-type MOS transistor TN11. The MOS transistor TP11, a resistor element R11, and the MOS transistor TN11 are connected in series between a power-source potential VCC and a ground. The connection node between the MOS transistor TN11 and the resistor element R11 is connected to the other input end of the NAND circuit NA11 through an inverter circuit IV12. This connection node is also grounded through a capacitor C11.

The output of the NAND circuit NA11 is supplied to each of the gates of a P-type MOS transistor TP12 and an N-type MOS transistor TN12. The MOS transistor TP12, a resistor element R12, and the MOS transistor TN12 are connected in series between a power source potential VCC and the ground. The connection node between the MOS transistor TP12 and the resistor element R12 is grounded through a capacitor C12. This connection node is also taken as an output through inverter circuits IV13 and IV14.

In the pulse generators thus constructed, for example, the periods of the pulses to be generated from the pulse generators PG1 and PG2 shown in FIG. 4 are adjusted by appropriately adjusting one or both of the resistor R12 and the capacitor C12.

Figure 6:
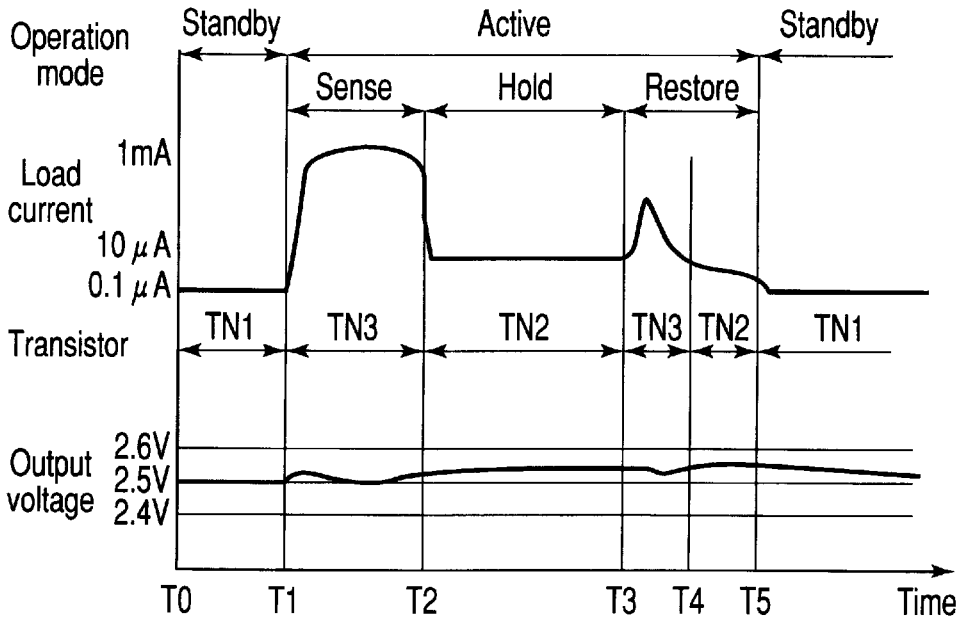
FIG. 6 is a graph showing the current, voltage, and operation modes in operation of the voltage generator circuit shown in FIG. 2.

Next, operations of the voltage generator circuit 12 shown in FIG. 2 and the control circuit 11 shown in FIG. 4 will be explained with reference to FIG. 6. FIG. 6 shows the current, voltage, and operation modes during operation of the voltage generator circuit 12.

As shown in FIG. 6, a standby signal "standby" is supplied to the control circuit 11, between time points T0 and T1. The signal "/small" therefore shifts to the low level, and the transistor TP1 of the voltage generator circuit 12 turns on. Accordingly, a current flows through the MOS transistor TN1. A current of 0.1 $\mu$A flows through the voltage generator circuit 12, so an output voltage of 2.5 V is outputted. During this period, the MOS transistors TP2 and TP3 are turned off, so that no current flows through the MOS transistors TN2 and TN3. In addition, the restore signal "restore" is set to the low level.

Next, at the time point T1, the active signal "active" starts being supplied to the control circuit 11. In correspondence with this signal, the pulse generator PG1 outputs a signal at the high level during the sensing period equivalent to the range between the time points T1 and T2 in FIG. 6. Accordingly, the signal "/large" goes to the low level. The MOS transistor TP3 of the voltage generator circuit 12 then turns on, so that a current flows through the MOS transistor TN3. A current of 1 mA therefore flows through the voltage generator circuit 12, as shown in FIG. 6, so that the voltage of about 2.5 V is outputted. In this period, the restore signal "restore" is at the low level. The NAND circuit NA of the control circuit 11 therefore does not satisfy input requirements, which sets the signal "/medium" at the high level. Note that the active signal "active" is kept at the high level until the time point T4.

Next, at the time point T2, the output signal of the pulse generator PG1 shifts to the low level. Both inputs of the NOR circuit NO then shift to the low level, which shifts output of the circuit NO to the high level. Accordingly, the signal "/large" shifts to the high level, and the signal "/medium" shifts to the low level, so that the MOS transistor TP2 in the voltage generator circuit 12 turns on. Therefore, a current of 10 $\mu$A flows as shown in FIG. 6, and a voltage of about 2.5 V is outputted.

Next, at the time point T3, the restore signal "restore" at the high level starts being supplied to the control circuit 11. In correspondence with this signal, the pulse generator PG2 supplies a signal at the high level during the period corresponding to the range between the time points T3 and T4 in FIG. 6. Accordingly, the output of the NOR circuit NO shifts to the low level. The signal "/large" shifts to the low level, and the signal "/medium" shifts to the high level. The MOS transistor TP3 in the voltage generator circuit 12 therefore turns on, so that a current flows through the MOS transistor TN3, as shown in FIG. 6. The output voltage is thus set to about 2.5 V. The restore signal "/restore" keeps the high level until the time point T5.

Next, at the time point T4, the output of the pulse generator PG2 shifts to the low level. Both inputs of the NOR circuit NO in the control circuit 11 then shift to the low level, so that the output of the circuit NO shifts to the high level. Accordingly, the signal "/large" shifts to the high level, and the signal "/medium" shifts to the low level. The MOS transistor TP2 in the voltage generator circuit 12 therefore turns on, so that a current flows through the MOS transistor TN2, as shown in FIG. 6. The output voltage at this time is set to about 2.5 V.

Next, at the time point T5, the active signal "active" and restore signal "restore" shift to the low level, and the standby signal "standby" shifts to the high level. Accordingly, the same operation as that between the time points T0 and T1 is carried out.

As described above, the voltage generator circuit according to the present embodiment of the invention has MOS transistors, which have different gate widths or driving capabilities from each other and are connected in parallel with each other. From the MOS transistors, a selection is made properly in accordance with the operation of the semiconductor memory device supplied with a voltage from the voltage generator circuit. Those MOS transistors that have capabilities corresponding to operations of the semiconductor memory device can thus be selected, so that a substantially constant potential is outputted independently from the size of the load current. A potential can be stably supplied to a semiconductor memory which has an access mode in which the holding period is long, particularly during operation in the page mode. Since the potential to be supplied to the semiconductor memory can be made constant, the reliability of the memory cells can be improved.

In addition, the voltage generator circuit selects MOS transistors by means of the control circuit. The control circuit is controlled by various control signals, which a conventional semiconductor memory is equipped with. The operations as described above can be realized without adding any new particular changes to the semiconductor memory.

(Second Embodiment)

Figure 7:
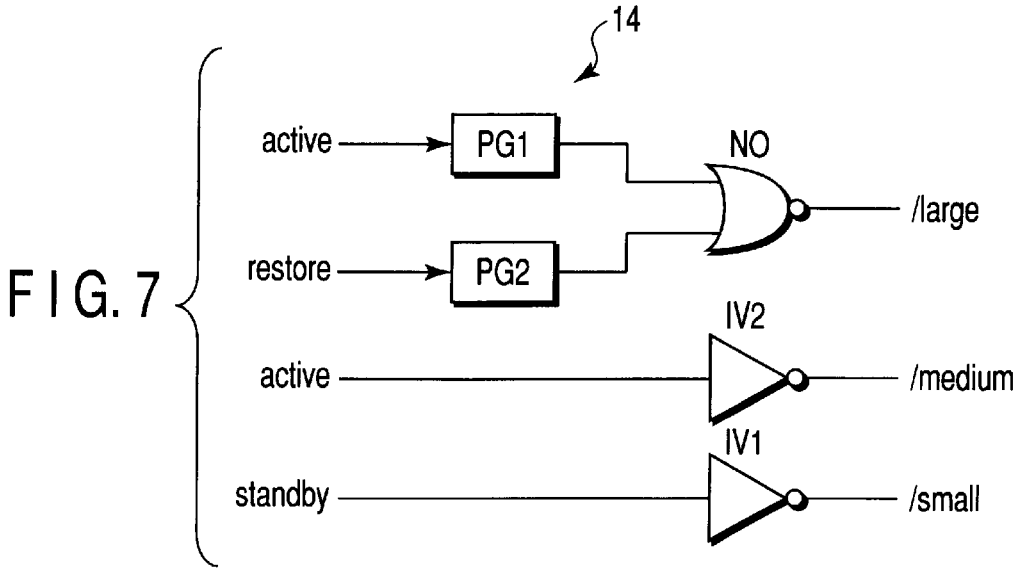
FIG. 7 is a diagram schematically showing another embodiment of a control circuit.

FIG. 7 shows another embodiment of the control circuit 11 shown in FIG. 2. The control circuit 14 has a structure which is substantially similar to that of the control circuit 13 shown in FIG. 4. The difference from the circuit 13 exists in that the signal "/medium" is generated by the signal "active" which has passed through the inverter circuit IV2.

Figure 8:
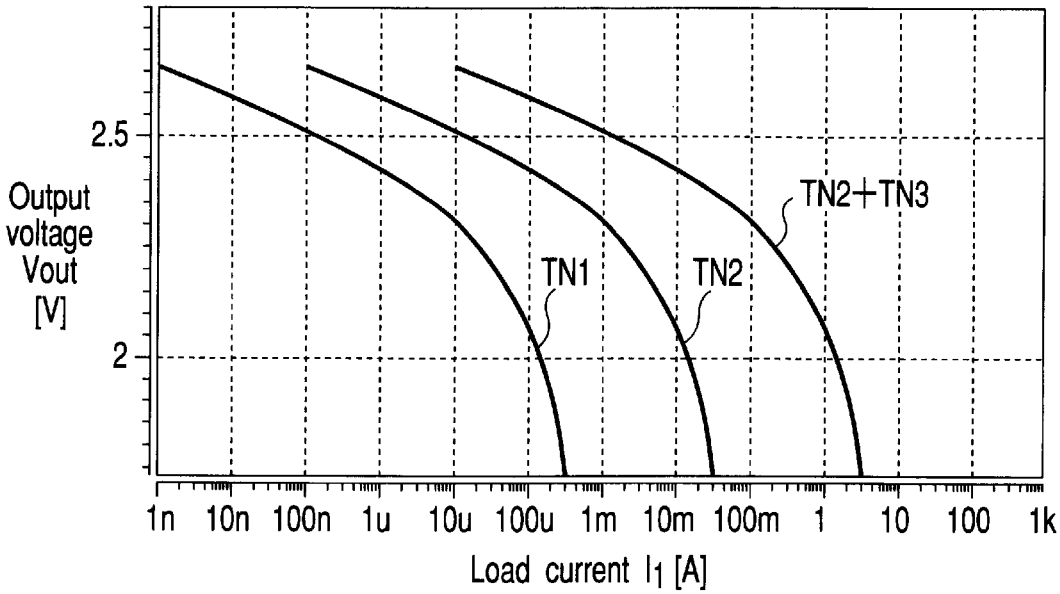
FIG. 8 is a graph showing load characteristics of respective MOS transistors where the control circuit shown in FIG. 7 is used.

Operations of the voltage generator circuit 12 using the control circuit 14 will now be explained with reference to FIGS. 7 and 8. The operations are basically similar to that using the control circuit 11 shown in FIG. 4. That is, while the signal "active " is supplied in FIG. 7, the signal "/large" is outputted and the signal "/medium" is also outputted. Therefore, the MOS transistors TN2 and TN3 in the voltage generator circuit 12 in FIG. 2 turn on simultaneously. The load characteristic at this time is indicated by "TN2+TN3" in FIG. 8. A desired output voltage can be maintained by the total sum of gate widths or driving capabilities of "TN2+ TN3", at the time of maximum load current. Other operations of the control circuit 12 are the same as those of the control circuit 14. Explanation of those operations will be omitted herefrom.

Figure 9:
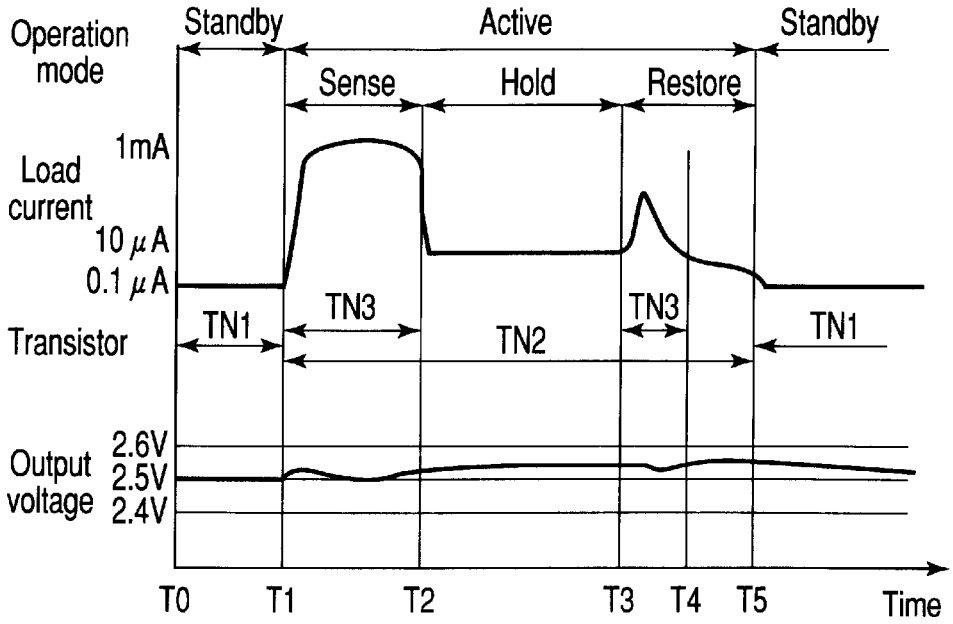
FIG. 9 is a graph showing the current, voltage, and operation modes in operation of the voltage generator circuit where the control circuit shown in FIG. 7 is used.
Figure 10:
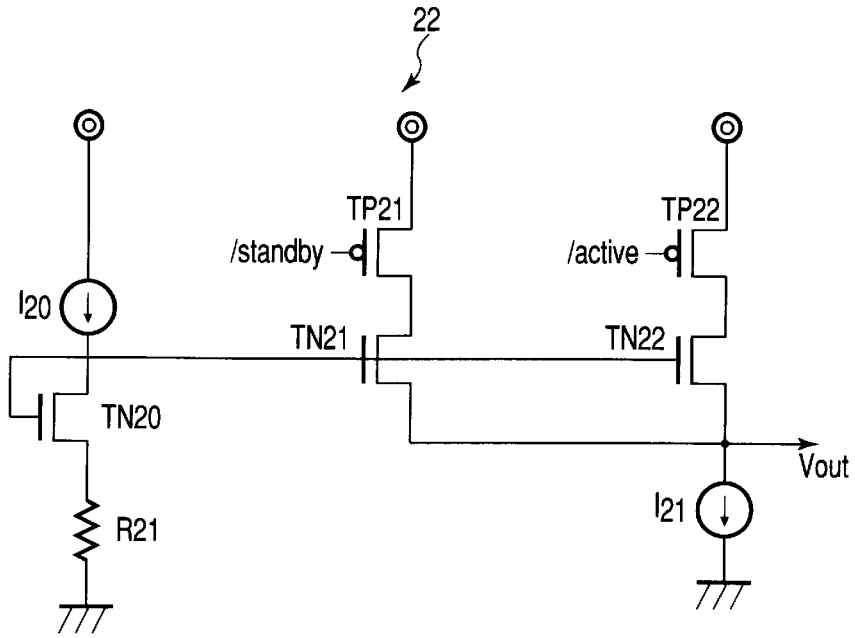
FIG. 10 is a diagram schematically showing a conventional voltage generator circuit.
Figure 11:
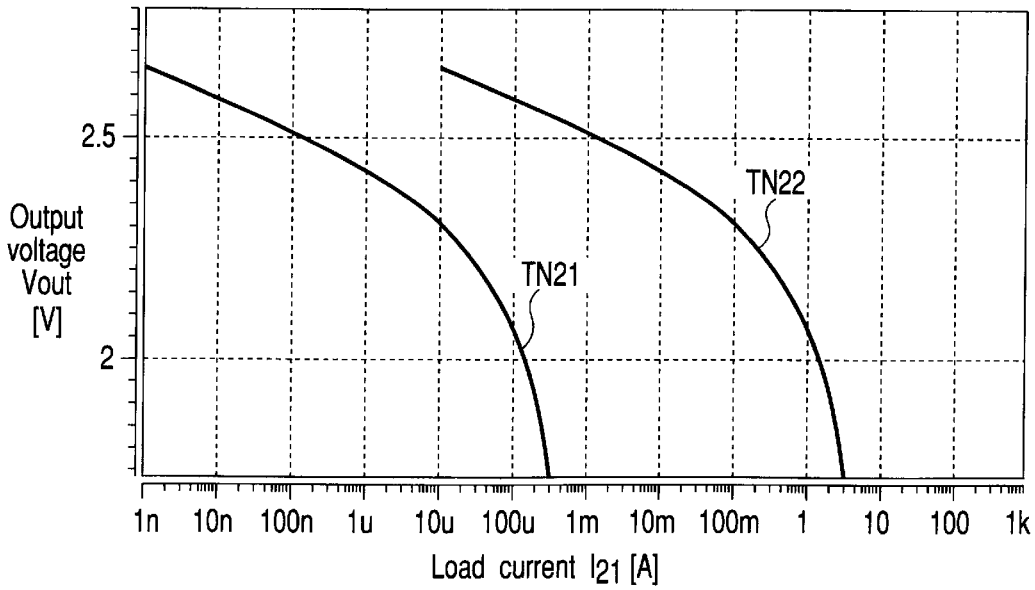
FIG. 11 is a graph showing load characteristics of respective MOS transistors.
Figure 12:
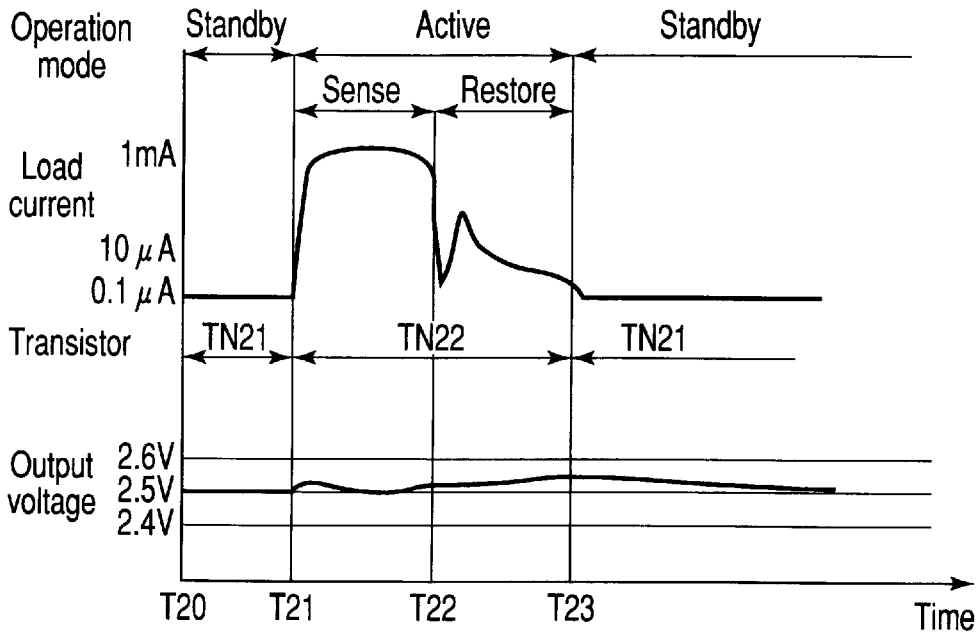
FIG. 12 is a graph showing the current, voltage, and operation modes in operation of the voltage generator circuit shown in FIG. 10.
Figure 13:
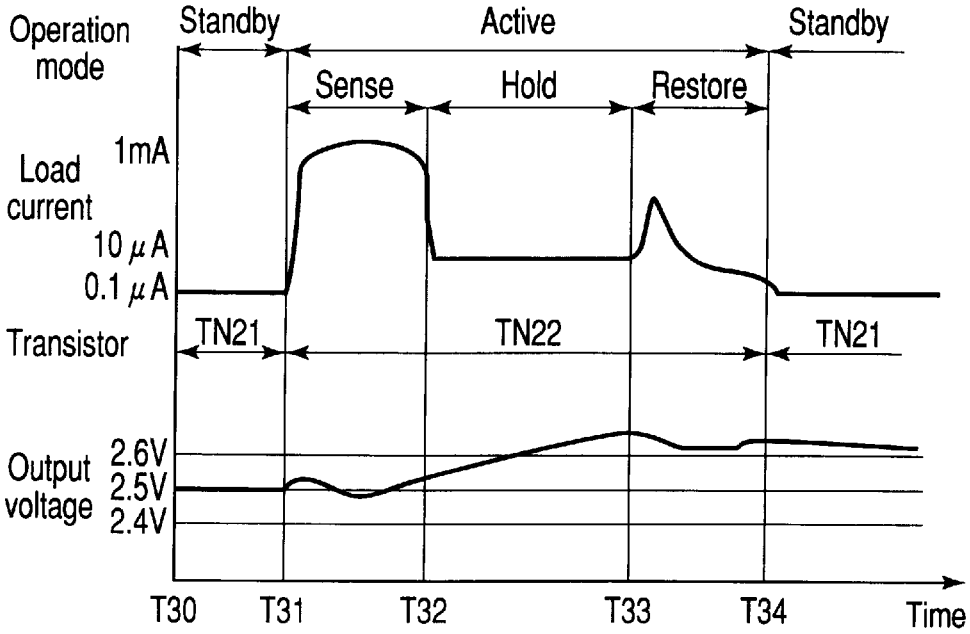
FIG. 13 is a graph showing the current, voltage, and operation modes where the conventional voltage generator circuit is adopted to a semiconductor device having another operation mode.

FIG. 9 shows the current, voltage, and operation modes of the voltage generator circuit 12 in case of using the control circuit 14 shown in FIG. 7. As shown in FIG. 9, in the standby mode between the time points T0 and T1, the MOS transistor TN1 is selected. During the sensing period between the time points T1 and T2, the MOS transistors TN2 and TN3 are selected. During the holding period between the time points T2 and T3, only the MOS transistor TN2 is selected. In the first half of the restoring period, i.e., between the time points T3 and T4, the MOS transistor TN3 is selected in addition to the MOS transistor TN2. In the last half of the restoring period, i.e., between the time points T4 and T5, only the MOS transistor TN2 is selected. After the time point T5, the MOS transistor TN1 is selected again.

According to the embodiment described above, it is possible to obtain the same effects as those in the case of using the voltage generator circuit 12 shown in FIG. 2 and the control circuit 11 shown in FIG. 4.

In the first embodiment described previously, MOS transistors having gate widths or driving capabilities different from each other are used, and one MOS transistor is driven corresponding to each operation mode. In the second embodiment, the MOS transistors TN2 and TN3 are driven to maintain a maximum load current (e.g., the sensing period and the first half of the restoring period). The present invention, however, is not limited hitherto. MOS transistors having different gate widths or driving capabilities may be prepared and combined appropriately to achieve control using the total sum of the gate widths or driving capabilities of selected MOS transistors. Alternatively, similar effects can be attained even by using MOS transistors having one equal gate width or driving capability. That is, according to the operation mode, the total sum of the gate widths or driving capabilities of selected MOS transistors may be adjusted appropriately so that a constant potential can be generated.

MOS transistors are used as the transistors in the above embodiments. The present invention, however, is not limited hitherto but MIS (Metal Insulator Semiconductor) transistors may be used.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A voltage generator circuit which generates a voltage supplied to an internal circuit, comprising:

a power source terminal supplied with a power source voltage;

first, second, and third switching elements each having first and second terminals, the first terminal of each of the switching elements being connected to the power source terminal;

a first transistor having a first driving capability and a current path which has first and second ends, the first end being connected to the second terminal of the first switching element;

a second transistor having a second driving capability different from the first driving capability and a current path which has first and second ends, the first end being connected to the second terminal of the second switching element;

a third transistor having a third driving capability different from the first and second driving capabilities and a current path having first and second ends, the first end being connected to the second terminal of the third switching element; and an output terminal which outputs the voltage supplied to the internal circuit and is connected to the second end of each of the current paths of the first, second, and third transistors.

2. The circuit according to claim 1, wherein the first to third switching elements turn on according to first to third operation modes corresponding to operations of the internal circuit.

3. The circuit according to claim 2, wherein the first switching element turns on in the first mode, the second switching element turns on in the second mode, and the third switching element turns on in the third mode.

4. The circuit according to claim 2, wherein the first switching element turns on in the first mode, the second switching element turns on in the second mode, and the second and third switching elements turn on in the third mode.

5. The circuit according to claim 1, wherein the first, second, and third driving capabilities are made different from each other by making gate widths of the first, second, and third transistors different from each other.

6. A voltage generator circuit which generates a voltage supplied to an internal circuit and which selects one of first to third modes in correspondence with operation of the internal circuit;

a power source terminal supplied with a power source voltage;

a first switching element which has first and second terminals and turns on in the first mode, the first terminal being connected to the power source terminal;

a second switching element which has first and second terminals and turns on in the second mode, the first terminal being connected to the power source terminal;

a third switching element which has first and second terminals and turns on in the third mode, the first terminal being connected to the power source terminal;

a first transistor having a first driving capability and a current path which has first and second ends, the first end being connected to the second terminal of the first switching element;

a second transistor having a second driving capability, which is greater than the first driving capability, and a current path which has first and second ends, the first end being connected to the second terminal of the second switching element;

a third transistor having a third driving capability, which is greater than the second driving capability, and a current path which has first and second ends, the first end being connected to the second terminal of the third switching element; and an output terminal which outputs the voltage supplied to the internal circuit and is connected to the second terminal of each of the current paths of the first, second, and third transistors.

7. The circuit according to claim 6, wherein the internal circuit is a semiconductor memory circuit, and the third mode is selected during a sensing period of the semiconductor memory circuit.

8. The circuit according to claim 6, wherein the internal circuit is a semiconductor memory circuit, and the third mode is selected during a predetermined period from start of restoration of the semiconductor memory circuit.

9. The circuit according to claim 6, wherein the internal circuit is a semiconductor memory circuit, and the second mode is selected during a predetermined period upon elapse of a sensing period of the semiconductor memory circuit.

10. The circuit according to claim 6, wherein the internal circuit is a semiconductor memory circuit capable of operating in a page mode, and the second mode is selected during an operation in the page mode.

11. The circuit according to claim 6, wherein the internal circuit is a semiconductor memory circuit, and the second mode is selected during a predetermined period upon elapse of a predetermined period from start of restoration of the semiconductor memory circuit.

12. The circuit according to claim 6, wherein the internal circuit is a semiconductor memory circuit, and the first mode is selected during a standby period of the semiconductor memory circuit.

13. The circuit according to claim 6, wherein the first, second, and third driving capabilities are made different from each other by making gate widths of the first, second, and third transistors different from each other.

14. A voltage generator circuit which generates a voltage supplied to an internal circuit and which selects one of first to third modes in correspondence with operation of the internal circuit;

a power source terminal supplied with a power source voltage;

a first switching element which has first and second terminals, the first terminal being connected to the power source terminal;

a second switching element which has first and second terminals, the first terminal being connected to the power source terminal;

a third switching element which has first and second terminals, the first terminal being connected to the power source terminal;

a first transistor having a first driving capability and a current path which has first and second ends, the first end being connected to the second terminal of the first switching element;

a second transistor having a second driving capability, which is greater than the first driving capability, and a current path which has first and second ends, the first end being connected to the second terminal of the second switching element;

a third transistor having a third driving capability, which is greater than the second driving capability, and a current path which has first and second ends, the first end being connected to the second terminal of the third switching element; and an output terminal which outputs the voltage supplied to the internal circuit and is connected to the second terminal of each of the current paths of the first, second, and third transistors, wherein the first switching element turns on in the first mode, the second switching element turns on in the second mode, and the second and third switching elements turn on in the third mode.

15. The circuit according to claim 14, wherein the internal circuit is a semiconductor memory circuit, and the third mode is selected during a sensing period of the semiconductor memory circuit.

16. The circuit according to claim 14, wherein the internal circuit is a semiconductor memory circuit, and the third mode is selected during a predetermined period from start of restoration of the semiconductor memory circuit.

17. The circuit according to claim 14, wherein the internal circuit is a semiconductor memory circuit, and the second mode is selected during a predetermined period upon elapse of a sensing period of the semiconductor memory circuit.

18. The circuit according to claim 14, wherein the internal circuit is a semiconductor memory circuit capable of operating in a page mode, and the second mode is selected during operation in the page mode.

19. The circuit according to claim 14, wherein the internal circuit is a semiconductor memory circuit, and the second mode is selected during a predetermined period upon elapse of a predetermined period from start of restoration of the semiconductor memory circuit.

20. The circuit according to claim 14, wherein the internal circuit is a semiconductor memory circuit, and the first mode is selected during a standby period of the semiconductor memory circuit.

21. The circuit according to claim 14, wherein the first, second, and third driving capabilities are made different from each other by making gate widths of the first, second, and third transistors different from each other.

* * * * *